US005970938A

United States Patent [19]

Hisamoto et al.

[11] Patent Number: 5,970,938

[45] Date of Patent: Oct. 26, 1999

[54] STARTER PROTECTION DEVICE

[75] Inventors: Motoi Hisamoto; Kazuya Tokugawa, both of Tokyo, Japan

[73] Assignee: Mitsubishi Denki Kabushiki Kaisha, Tokyo, Japan

[21] Appl. No.: 09/081,101

[22] Filed: May 19, 1998

[30] Foreign Application Priority Data

Dec. 26, 1997 [JP] Japan ..... 9-359484

[51] Int. Cl.[6] ..... F02N 11/08

[52] U.S. Cl. ..... 123/179.3

[58] Field of Search ..... 123/179.3, 179.1; 290/38 R, 38 C

[56] References Cited

U.S. PATENT DOCUMENTS

| | | | |
|---|---|---|---|
| 4,490,620 | 12/1984 | Hansen | 123/179.3 |
| 4,494,162 | 1/1985 | Eyler | 123/179.1 |
| 4,803,377 | 2/1989 | Iwatani et al. | 290/38 R |
| 4,947,051 | 8/1990 | Yamamoto et al. | 123/179.3 |
| 5,601,058 | 2/1997 | Dyches et al. | 123/179.3 |
| 5,742,137 | 4/1998 | Bratton et al. | 290/38 R |

FOREIGN PATENT DOCUMENTS 7-23575 5/1995 Japan .

*Primary Examiner*—Willis R. Wolfe
*Assistant Examiner*—Hieu T. Vo
*Attorney, Agent, or Firm*—Sughrue, Mion, Zinn, Macpeak & Seas, PLLC

[57] ABSTRACT

A starter protection device which substantially operates with only a signal from a key switch, does not require wiring from an alternator or the like, and can be standardized and reduced in size can be obtained. The starter protection device for opening a starter auxiliary switch (5) under a certain condition to protect a starter (2) for starting an engine, by making the starter (2) inoperable. The starter protection device comprises a switch circuit (716) closed by turning on a key switch (6) for closing the starter auxiliary switch (5), a timer circuit (715) that starts operating at the same time the key switch (6) is turned on, and a timer circuit (710) that starts operating at the same time the key switch (6) is released, wherein the opening and closing of the switch circuit (716) is controlled based on outputs of the first and second timer circuits.

7 Claims, 6 Drawing Sheets

STARTER PROTECTION DEVICE

BACKGROUND OF THE INVENTION

1. Field of the Invention

The present invention relates to a starter protection device for protecting a starter by preventing a continuous supply of electric power to the starter and by preventing accidental activation of the starter during inertial rotation of an engine or the starter.

2. Description of the Prior Art

Generally, a starter for starting an engine is activated by turning to a start position of a key switch, thereby igniting and starting the engine. After ignition and starting of the engine, the starter is itself stopped by turning the key switch off of the start position.

If the key switch cannot be returned from start position for some reason, and the starter continues operating even after the engine starts, the starter will be damaged by overheating.

In addition, if the engine fails to immediately ignite when the key switch is turned to the start position, and the key switch is then turned immediately both off and on the start position, then the starter will be activated as the engine or starter is still rotate, thereby damaging the ring gear of the engine or the starter.

Therefore, a starter protection device has been in use which protects the starter by detecting from the starting state of the engine through the engine speed from voltage generated by an alternator or the like.

FIG. 6 shows an arrangement of such a conventional starter protection device for a motor vehicle.

In the figure, a starter 2 is connected across a car battery 1, and mainly consists of a main switch 3 and a motor 4. The main switch 3 has coils 3*a*, 3*b*, and a contact 3*c*. One end of the contact 3*c* is connected to a positive terminal of the battery 1, while the other end is connected to a negative terminal of the battery 1 through the motor 4. The coils 3*a* and 3*b* are connected in series and are connected in parallel across the motor 4. A common connection point of the coils 3*a* and 3*b* is connected to the positive terminal of the battery 1 and a movable terminal of a key switch 6 through a contact 5*b* of a starter auxiliary switch 5. The key switch 6 has the following fixed terminals, an OFF terminal, an IG terminal (ON terminal), and an ST terminal, as well as a movable terminal. The movable terminal is connected to the positive terminal of the battery 1.

A starter protection device 7 protects the starter 2 by controlling the starter auxiliary switch 5, and comprises a frequency-voltage converter (hereinafter called an "F-V converter") 701 for converting the frequency of alternating current voltage generated by an alternator 8 in response to the rotation of the engine into direct current voltage, and a comparator 702 which is supplied with the output voltage of the F-V converter 701 at its inverted input terminal and compares this voltage with a predetermined value previously applied to its non-inverted input terminal. The predetermined value of the comparator 702 is established by voltage divider resistors 703 and 704. The output terminal of the comparator 702 is connected to the base of an output transistor 705.

The starter protection device 7 further comprises a power supply circuit 706 connected to the IG terminal of the key switch 6, and a timer circuit 710 which is supplied with power supply from the power supply circuit 706. The power supply the power supply circuit 706 is arranged to also supply power to the F-V converter 701 and the comparator 702. A smoothing capacitor 707 is connected to the output side of the power supply circuit 706.

The input side of the timer circuit 710 is connected to the common connection point of the main switch 3 and the auxiliary switch 5 through an inverter 708. The common connection point is grounded through a resistor 709. The output side of the timer circuit 710 is connected to the base of the output transistor 705 through an inverter 711, and the IG terminal of the key switch 6 through a resistor 712. The collector of the output transistor 705 is connected to the ST terminal of the key switch 6 through a coil 5*a*, of the auxiliary switch 5, and a diode 713, which are parallel connected, and its emitter is grounded. The diode 713 is a so-called fly-wheel diode for controlling surge voltage generated in the coil 5*a* of the auxiliary switch 5 when the output transistor 705 is turned off.

Now, the operation will be described.

When the key switch 6 is closed through the IG terminal, voltage of the battery 1 is applied to the power supply circuit 706 of the starter protection device 7, and to the base of the output transistor 705, whereby the output transistor 705 becomes conductive.

Then, when the key switch 6 is closed through the ST terminal position, current flows from the battery 1 through the coil 5*a* of the starter auxiliary switch 5 and the output transistor 705, thereby energizing the coil 5*a* of the auxiliary switch 5 to close its contact 5*b*. Closing the contact 5*b* causes electric power to be supplied to the coil 3*a* of the main switch 3 of the starter 2, and closes its contact 3*c*. Then, the voltage of the battery 1 is applied to the motor 4 of the starter 2, and the motor 4 starts rotating to start the engine (not shown).

As the engine increases its speed, the alternator 8 begins power generation. Then, the frequency of the alternating current voltage from the alternator 8, which is input to the F-V converter 701, increases as the engine speed increases, and the output of the F-V converter 701 also increases proportional to the input.

When the engine speed reaches a starter disengaging speed, the output of the F-V converter 701 exceeds a predetermined value, whereby the comparator 702 becomes conductive: that is, its output level is changed over to the low level "L."

This turns off the output transistor 705. The coil 5*a* of the auxiliary switch 5 is deenergized to open its contact 5*b*. Power supply to the main switch 3 of the starter 2 is stopped to stop the motor 4 of the starter 2, the starter 2 is disengaged from the engine to prevent continuous power supply.

On the other hand, as described above, in a series of operations for turning on the output transistor 705 by changing over the key switch 6 from the OFF terminal to the IG terminal and then to the ST terminal to rotate the motor 4 of the starter 2 and thereby start the engine, when the key switch 6 is disconnected from the ST terminal before the output transistor 705 is turned off, the key switch 6 returns to the IG terminal to deenergize the coil 5*a* of the starter auxiliary switch 5 and to open its contact 5*b*. Thus, the current is shut off from flowing through the coils 3*a* and 3*b* of the main switch 3 of the starter 2, so that the potential of the common connection point of the starter auxiliary switch 5 and the main switch 3, or the potential of the input of the inverter 708 becomes substantially the low level "L", and the input side of the timer circuit 710 is supplied with a high level input signal "H" inverted by the inverter 708.

The timer circuit 710 starts operating in synchronization with the application of input signal, and generates a high level output signal "H" at its output side for a predetermined period of time. The high level signal "H" is inverted by the inverter 711 into a low level signal "L," and supplied to the base of the output transistor 705. Therefore, even if the key switch 6 is turned to the ST terminal position again, the output transistor 705 maintains the OFF state during the predetermined period of time the timer circuit 710 operates. That is, even if the key switch 6 is turned to the ST terminal position during the predetermined period of time the timer circuit 710 continues operating after stopping power supply to the starter, no current flows through the coils 3*a* and 3*b* of the main switch 3, and the contact 3*c* remains open, so that the starter 2 cannot be operated. Thus, accidental activation is prevented during inertial rotation of the engine or the motor 4 of the starter 2.

However, the conventional starter protection device for detecting the starting state of the engine with the voltage generated by the alternator as described above has a problem in that it cannot be installed on an engine without an alternator.

In addition, the conventional starter protection device described above has a problem in that wiring from the alternator and the IG terminal of the key switch starter protection device is required.

The present invention is made to eliminate the problems described above, and is intended to provide a starter protection device substantially that operates only by a signal from a key switch, does not require wiring from an alternator or the like.

SUMMARY OF THE INVENTION

According to one aspect of the present invention, a starter protection device for opening a starter auxiliary switch under certain conditions to protect a starter for starting an engine thereby making the starter inoperable comprises: a switch means closed by turning on a key switch for closing the starter auxiliary switch, a first timer circuit that starts operating at the same time the key switch is turned on, and a second timer circuit that starts operating at the same time the key switch is released, wherein the opening and closing of the switch means is controlled based on outputs of the first and second timer circuits.

According to this arrangement, when an engine is equipped with an alternator, it is not necessary to provide wiring connecting the alternator and the starter protection device, or wiring from an IG terminal of the key switch to the starter protection device. Hence, the device can be easily installed, its workability is improved and it can be standardized because it does not need to be compatible with other devices. Its size can also be reduced and its cost lowered.

In addition, the present invention has advantages in that it can also apply to an engine that is not equipped with an alternator, and the general area of its usage can be expanded, and has an additional advantage in terms of installation space.

In one form of the invention, the switch means is opened after the expiration of a predetermined period of time in which the first timer circuit operates and remains open during a predetermined period of time in which the second timer circuit operates. This prevents continuous power supply so that the starter can be protected from thermal damage. In addition, the present invention has an advantage in that accidental activation of the starter during the inertial rotation of an engine or the starter is prevented, so that the ring gear and the starter can be protected from impacts due to such accidental activation.

In another form of the invention, the switch means comprises a leakage current prevention circuit including a first switch element which becomes conductive as soon as the key switch is turned on, and a switch circuit including a second switch element which becomes conductive as soon as the first switch element becomes conductive and a bridge circuit located between a control electrode of the second switch element and the first and second timer circuits. This provides advantages in that a dark current can be prevented from flowing from the battery to the starter protection device and the starter auxiliary switch can be reliably controlled.

In a further form of the invention, the starter protection device further comprises a power supply circuit connected to the switch means which is operated as soon as the key switch is turned on to supply power to the first and second timer circuits. This provides an advantage in that the first and second timer circuits can be reliably operated.

In a still further form of the invention, at least one of the first and second timer circuits is arranged in an intermittent charge/discharge circuit. This provides an advantage in that a small capacity capacitor can be used so that the device can have a smaller size.

In a yet further form of the invention, the starter auxiliary switch is integrated with circuit components other than those of the starter auxiliary switch. This provides advantages in that such an arrangement makes installation on the starter itself easy, and a conventional switch can be used for the starter auxiliary switch so that a product with higher compatibility can be provided.

In still another form of the invention, the starter protection device further comprises a CPU for checking the operation of the key switch, and the first and second timer circuits with the switch means being controlled on the basis of a control signal from the CPU. This provides advantages in that a starter can be more accurately protected and the circuit arrangement can be simplified.

DETAILED DESCRIPTION OF THE PREFERRED EMBODIMENTS

Starter protection devices according to embodiments of the present invention will now be described with reference to the drawings by way of examples in which the starter protection device is installed on a vehicle similar to that in FIG. 6.

Embodiment 1

Figure 1:
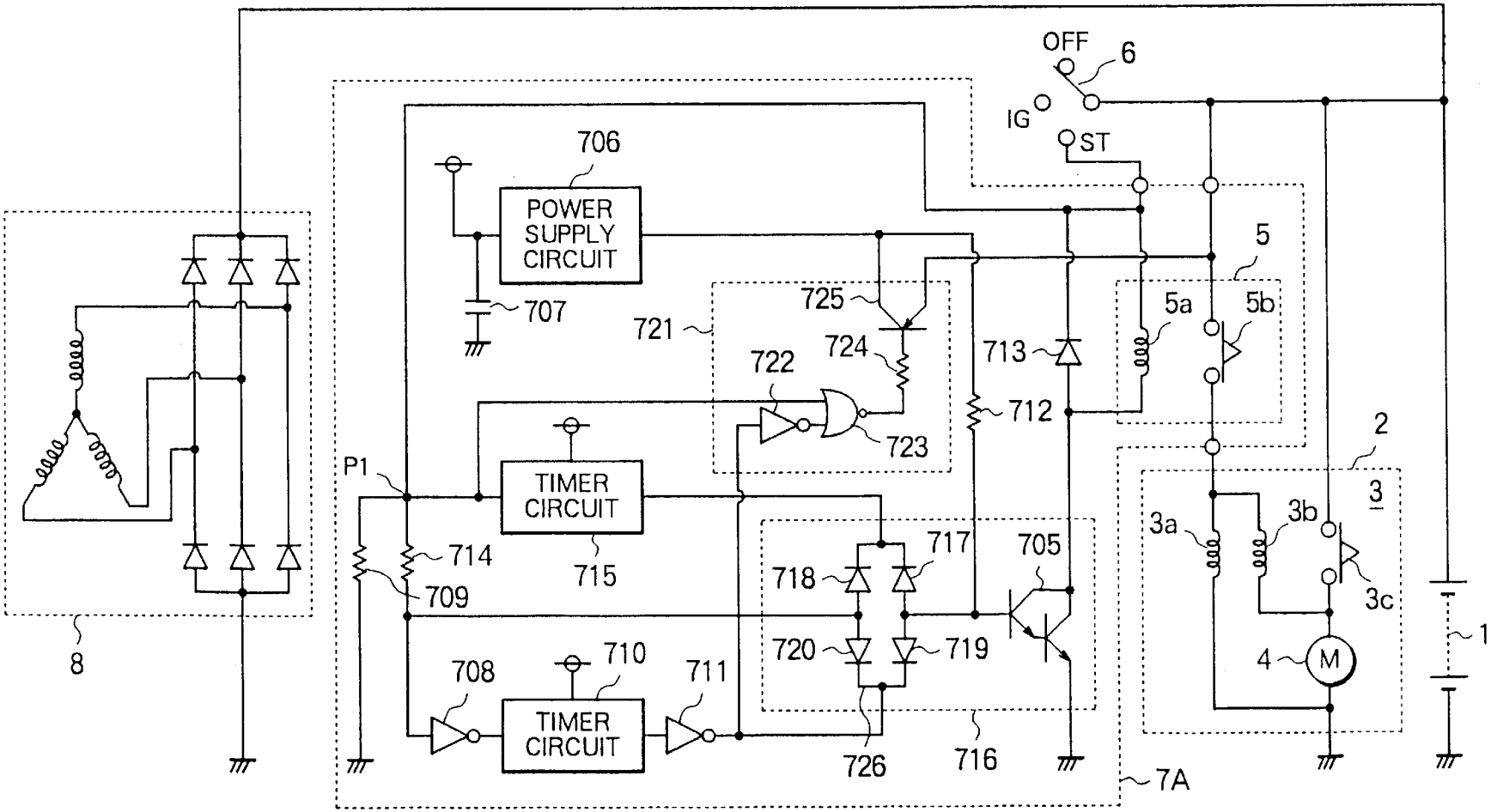
FIG. 1 is a block diagram showing embodiment 1 of the present invention.

FIG. 1 is a block diagram showing embodiment 1 of the present invention.

Figure 6:
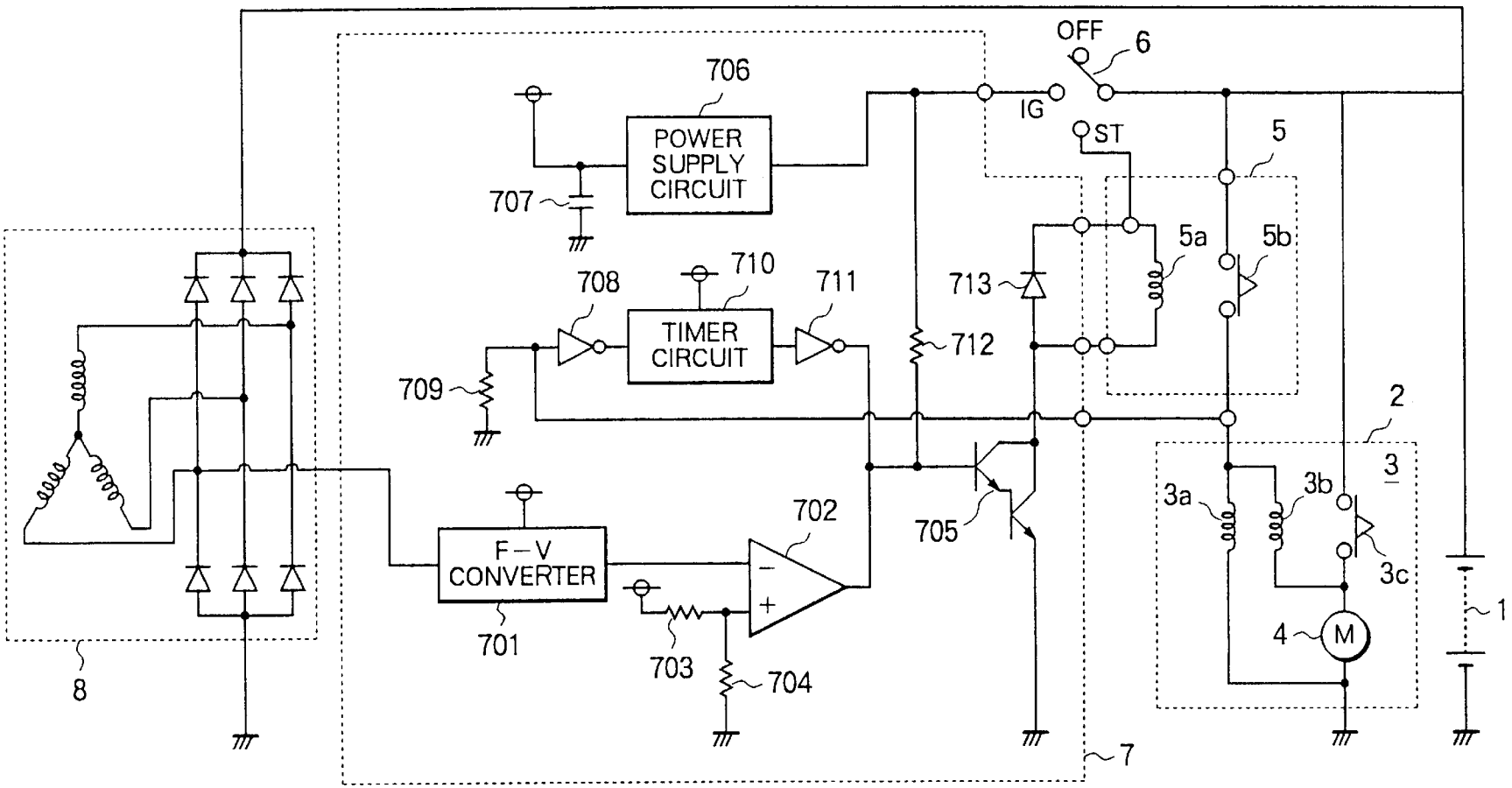
FIG. 6 is a block diagram showing a conventional starter protection device for a motor vehicle.

In the figure, like reference numerals denote components similar to those in FIG. 6, and their detailed description is omitted.

In the figure, a starter 2, a starter auxiliary switch 5, a key switch 6, and an alternator 8 are connected to a battery 1 in a manner similar to that in FIG. 6.

A starter protection device 7A of the embodiment comprises a power supply circuit 706, and a timer circuit 710 for preventing accidental activation during inertial rotation of an engine or starter, and further comprises a timer 715 for preventing a continuous power supply, a switch circuit 716 that is controlled by outputs of the timer circuits 710 and 715, and a leakage current prevention circuit 721. Here, the switch circuit 716 together with the leakage current prevention circuit 721 constitute a switch means.

In addition, in the embodiment, the starter auxiliary switch 5 is contained in and substantially integrated with the starter protection device 7A.

The switch circuit 716 of the starter protection device 7A has an output transistor 705, and a plurality of diodes 717–720 constituting a bridge circuit 726. A common connection point of the anodes of diodes 717 and 719 is connected to the base of the output transistor 705, and to the input side of the power supply circuit 706 through a resistor 712.

In addition, a common connection point of the anodes of diodes 718 and 720 is connected to the input side of the timer circuit 715 as a first timer circuit through a resistor 714, and to the input side of the timer circuit 710 as a second timer circuit through an inverter 708. A common connection point P1 of the resistor 714 and the timer circuit 715 is grounded through a resistor 709, and connected to an ST terminal of the key switch 6.

The leakage current prevention circuit 721 prevents leakage current (dark current) from flowing from the battery 1 to the power supply circuit 706 and comprises: an inverter 722 connected to the output side of the inverter 711: a NOR circuit 723 having one of its input side terminals connected to the output side of the inverter 722 and having the other input terminal connected to the common connection point P1 of the resister 714 and the timer circuit 715; and a transistor 725 having its base connected to the output side of the NOR circuit 723 through a resistor 724, having its emitter connected to the positive pole of the battery 1, and having its collector connected to the input side of the power supply circuit 706.

A capacitor 707 connected to the output side of the power supply circuit 706 is substantially used as backup for the power supply herein.

In addition, the collector of the output transistor 705 is connected to the scf terminal of the key switch 6 through the diode 713, and its emitter is grounded. Furthermore, the IG terminal of the key switch 6 is not connected to the starter protection device 7A herein, but connected to accessories such as a conventional computer for performing engine control or to audio equipment and the like.

Figure 2:
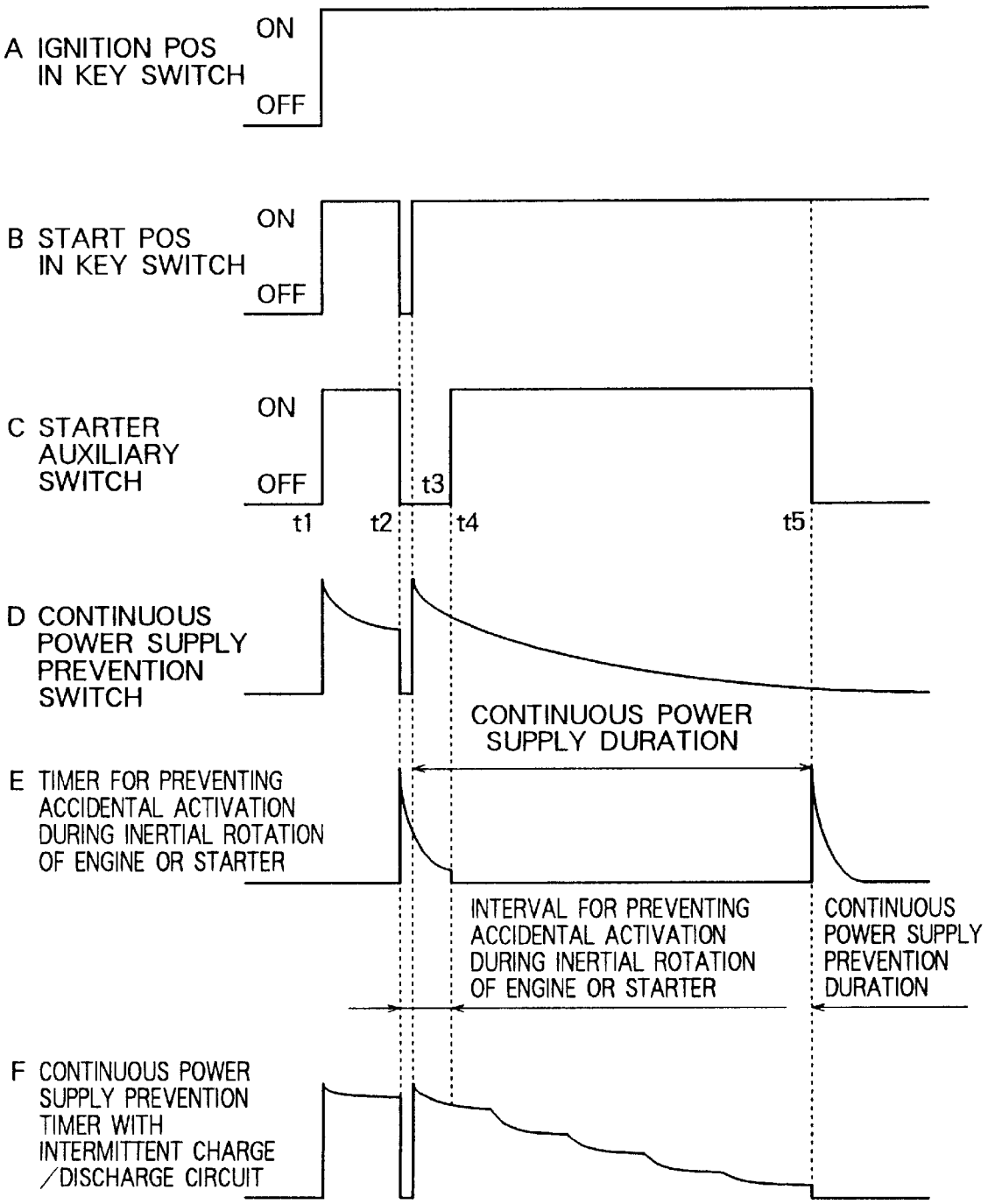
FIG. 2 is a waveform diagram illustrating the operation of embodiment 1 of the present invention.

Operation will now be described with reference to the waveforms of FIG. 2.

When the key switch 6 is turned from the OFF terminal past an IG terminal (ignition switch on) (FIG. 2A) to the ST terminal (start switch on) (FIG. 2B), the potential of the common connection point P1 becomes a high level "H," and the output of the NOR circuit 723 in the leakage current prevention circuit 721 becomes a low level "L," and the transistor 725 is thereby turned on. Consequently, voltage of the battery 1 is applied to the power supply circuit 706 and to the base of the output transistor 705 through the resistor 712, and the output transistor 705 is thereby turned on.

Accordingly, current flows from the battery through the output transistor 705 and a coil 5*a* of the starter auxiliary switch 5 to energize the coil 5*a* of the starter auxiliary switch 5 and close the contact 5*b*. The closing of the contact 5*b* (FIG. 2C) causes power to be supplied to coils 3*a* and 3*b* of the main switch 3 in the starter 2 to close its contact 3*c*. Then, voltage of the battery 1 is applied to the motor 4 of the starter 2, to thereby start rotation of the motor 4 to start the engine (not shown).

In addition, when the potential of the common connection point P1 becomes the high level "H," a signal is input into the timer circuit 715 which starts its operation in synchronization with the application of this input signal (FIG. 2D). A high level "H" output signal is generated at the output side of the timer circuit is for a predetermined duration, for example, several tens of seconds (Continuous Supply Duration in FIG. 2D), and is supplied to the bridge circuit 726 of the switch circuit 716.

On the other hand, the high level "H" signal from the common connection point P1 passes through the resistor 714, is inverted by the inverter 708 and input into the timer circuit 710. Consequently, the output signal of the timer circuit 710 is at the low level "L." This signal is inverted into a high level "H" signal by the inverter 711, and is similarly supplied to the bridge circuit 726 of the switch circuit 716. In this condition, every one of the diodes 717–720 constituting the bridge circuit 726 of the switch circuit 716 is nonconductive, and the output transistor 705 is in the ON state.

Then, the timer circuit 715 stops operating after a predetermined period of time expires and outputs a low level "L" output signal. Consequently, the diodes 717 and 718 of the switch circuit 716 become conductive, the base potential of the output transistor 705 becomes the low level "L," and the output transistor 705 is turned off. Thus, the current is shut off from flowing through the coil 5*a* of the starter auxiliary switch 5 to deenergize the coil 5*a*, and open the contact 5*b*. The power supply for the main switch 3 of the starter 2 is stopped to stop the motor 4 of the starter 2. Then, the starter 2 is disengaged from the engine, and continuous power supply is prevented (at the time t5 and thereafter in FIG. 2). Thus, it is possible to automatically stop the starter 2 which is protected from thermal damage.

In this way, although the starter 2 operates while the timer circuit 715 is generating the high level "H" output signal for a predetermined period of time if the key switch 6 is released from the ST terminal before the predetermined period of time expires, the key switch 6 returns to the IG terminal (between time t2 and t3 in FIG. 2B), the potential of the common connection point P1 substantially becomes the low level "L," and the input signal of the timer circuit 715 becomes the low level "L." Thus, the output signal of the timer circuit 715 is forced to become the low level "L." Consequently, the diodes 717 and 718 of the switch circuit 716 are conductive and change the base potential of the output transistor 705 to the low level "L," and the output transistor 705 is turned off.

At this time, since the input side of the inverter 708 also becomes the low level "L" through the diode 718, the timer circuit 710 starts its operation in synchronization with the inverted signal of this signal, namely, the high level "H" (FIG. 2E). A high level "H" output signal is generated at the output side of the inverter 708 for a predetermined period of time, for example, several seconds (between time t2 and t4 in FIG. 2E). This signal is inverted into a low level "L" signal by the inverter 711. Consequently, the diodes 719 and 720 become conductive to turn the base potential of the output transistor 705 into the low level "L" and turn off the output transistor 705. This state continues for a predetermined period of time when the timer circuit 710 is generating the high level "L" signal.

Accordingly, even if the key switch 6 is again turned to the ST terminal position again, the input of the inverter 708 is maintained at the low level "L" state through the diode 720 because the output of the inverter 711 is at the low level "L" for the predetermined period of time when the timer circuit 710 is operating. Thus, even if the key switch 6 is turned to the ST terminal position for the predetermined period of time when the timer circuit 710 is operating after power supply for the starter is stopped, current does not flow through the coils 3a and 3*b* of the main switch 3 and the contact 3*c* remains opened, so the starter 2 does not operate. Thus, accidental activation is prevented during inertial rotation of the engine or the motor 4 of the starter 2 (between time t2 and t4 in FIG. 2). Hence, the ring gear (not shown) and the starter 2 can be protected from impact due to accidental activation during inertial rotation of the engine or the starter.

Then, since the output of the inverter 711 becomes the high level "H" after the predetermined period of operating time of the timer circuit 710 expires, the output transistor 705 is turned on so the starter 2 can operate. Incidentally, although the transistor 725 of the current leakage prevention circuit is on when the common connection point P1 is at the high level "H" and current can be supplied from the battery 1 to the power supply circuit 701, as shown above, the potential of the common connection point P1 becomes the low level L when the timer circuit 710 is operated. Consequently, the output transistor 705 is turned on and power supply from the battery 1 to the power supply circuit 706 can not be maintained during the predetermined period of time the timer circuit 710 substantially outputs a high level "H" output signal.

Here, when the potential of the common connection point P1 changes from the high level "H" to the low level "L," the inverter 722 inverts a resulting low level "L" output signal of the inverter 711 which is located at the output side of the timer circuit 710 and supplies it to the NOR circuit 723. A low level "L" signal is taken out at the output side of the NOR circuit 723, thereby turning on the transistor 725 to assure power supply from the battery 1 to the power supply circuit 706 until the predetermined period of operating time of the timer circuit 710 expires.

Operation until power supply to the power supply circuit 706 is assured is substantially performed by voltage charged in a capacitor 707 located at the output side of the power supply circuit 706.

Figure 3:
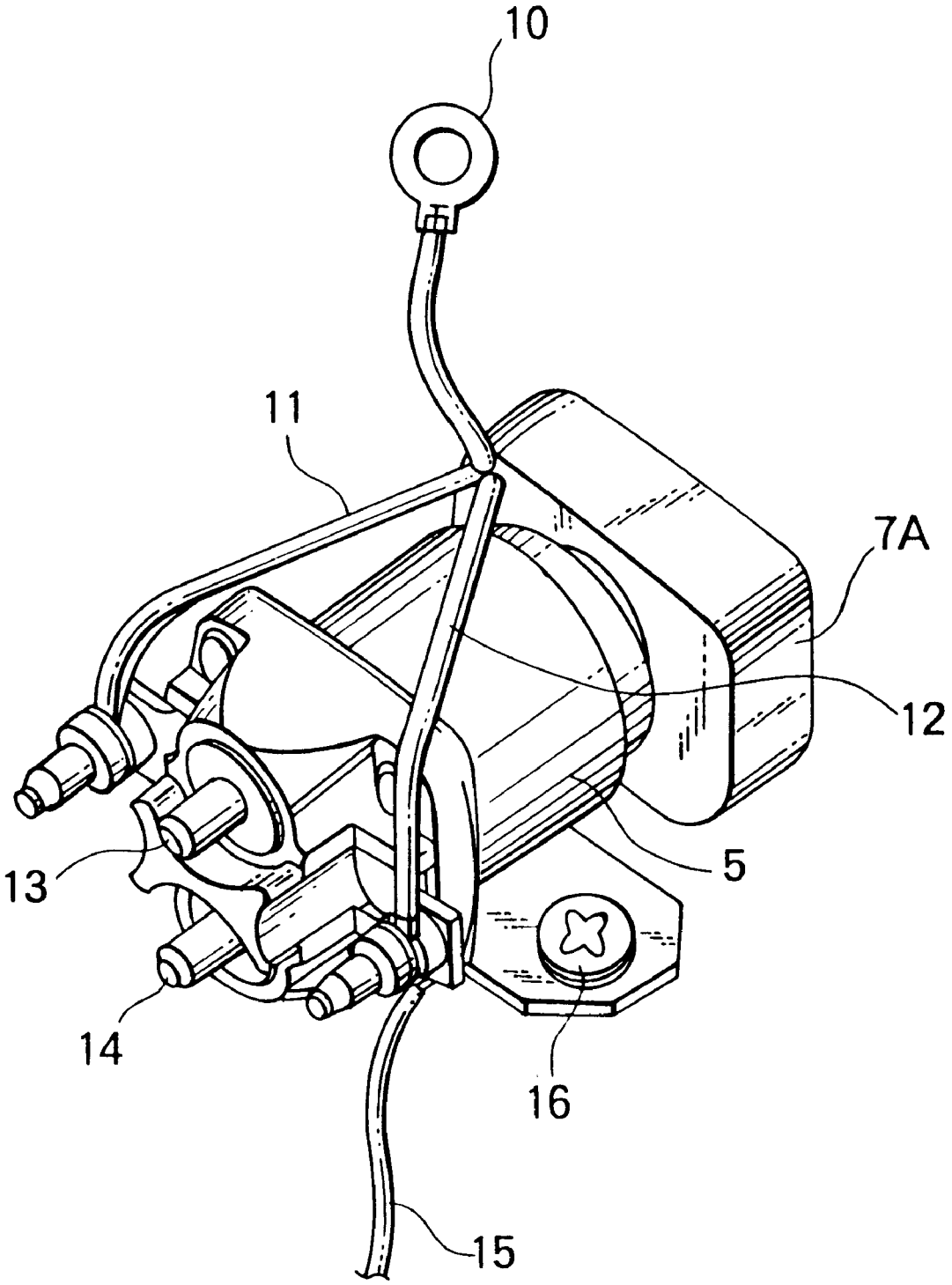
FIG. 3 is a perspective view showing an integrated structure of embodiment 1 of the present invention.

FIG. 3 is a perspective view schematically showing the external appearance of the starter protection device for a motor vehicle according to embodiment 1 of the present invention.

In the figure, wiring 10 and 11 extend from the body of the starter protection device 7A. The wiring 10 connects the transistor 725 of the leakage current prevention circuit 721 in the starter protection device 7A to the positive pole of the battery 1, while the wiring 11 connects one end of the coil 5*a* of the auxiliary switch 5 to the common connection point of the collector of the output transistor 705 of the switch circuit 716 and the fly-wheel diode 713. Wiring 12 connects the other end of the coil 5*a* of the auxiliary switch 5 to the common connection point P1. The fixed terminals 13 and 14 of the contact 5*b* of the starter auxiliary switch 5 are arranged to be electrically engaged with the connections of the coils 3*a* and 3*b* of the main switch 3, and the connections of the key switch 6 and the battery 1, respectively.

The terminal 15 connected to the coil 5*a* of the starter auxiliary switch 5 is connected to the ST terminal of the key switch 6. Thus, the starter auxiliary switch 5 of the starter protection device 7A is structurally integrated with other circuit components, and is secured on the starter body with a flange screw 16.

As described, since in the embodiment it is not necessary to detect the starting state of the engine by engine speed from utilizing voltage generated by an alternator or the like, there is no need to provide wiring (harness line) to connect the alternator and the starter protection device. In addition, the starter protection device is arranged to be substantially operated by only the signal from the ST terminal of the key switch, so there is also no need to provide wiring (harness line) from the IG terminal of the key switch to the starter protection device. Hence, the device can be easily installed and workability is improved. Furthermore, standardization can be achieved because compatibility with other devices is not required, and it is possible to decrease the size while yet reducing the cost.

In addition, the present invention can be applied to an engine without an alternator, such as an emergency generator, which can expand its general area of application and is also advantageous in terms of space.

Furthermore, the starter protection device can be installed on the body of the starter by substantially integrating the starter auxiliary switch with other circuit components. Nevertheless, a conventional starter auxiliary switch can be used and compatibility can be provided in the product.

Embodiment 2

When a relatively long period of time is required for the operation of the timer circuit in the starter protection device 7A, especially, for the timer circuit 715 for preventing continuous power supply, the capacity of the capacitor may be reduced by employing an intermittent type charge/discharge circuit which comprises a transistor that is turned on and off in response to a signal from an oscillator circuit, and a resistor and a capacitor which are intermittently controlled by the turning on and turning off of the transistor.

Figure 4:
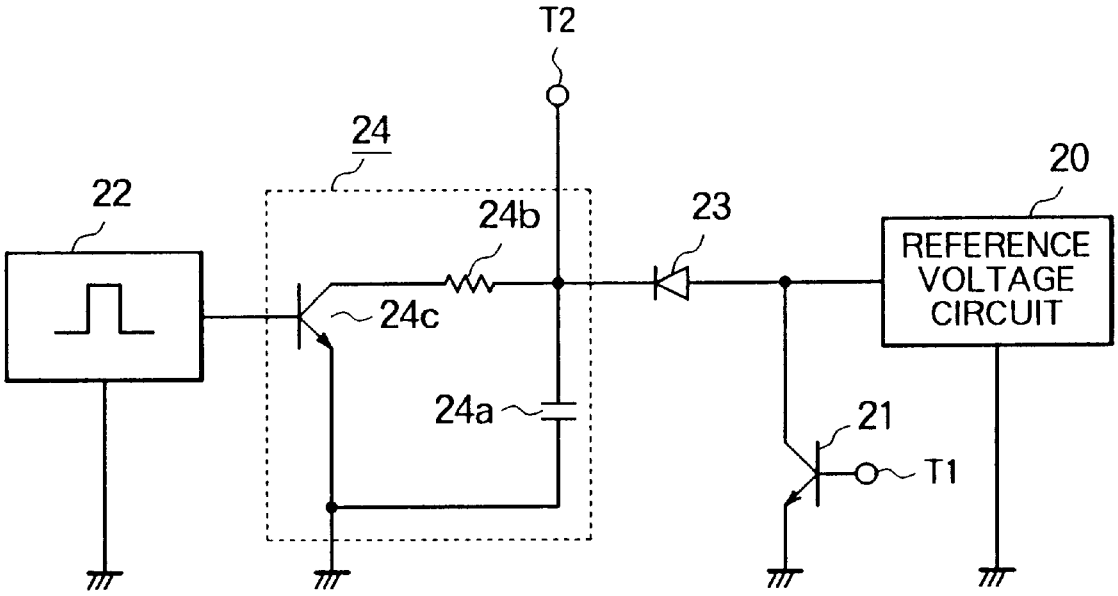
FIG. 4 is a block diagram showing embodiment 2 of the present invention.

FIG. 4 is a block diagram showing an example of the present embodiment.

FIG. 4, a timer circuit comprises a reference voltage circuit 20, a transistor 21 disposed between an output terminal of the reference voltage circuit 20 and the ground, and an intermittent type charge/discharge circuit 24, which is disposed between an output terminal of the reference voltage circuit 20 and an oscillator circuit 22 which generates a pulse signal through a diode 23. The collector of the transistor 21 is connected to the output terminal of the reference voltage circuit 20, its emitter is grounded, and its base is connected to an input terminal T1 of the timer circuit.

The charge/discharge circuit 24 consists of a capacitor 24*a* set to a predetermined time constant, a resistor 24*b*, and a transistor 24*c*. One end of the capacitor 24*a* and one end of the resistor 24*b* are commonly connected, connected to the cathode of the diode 23, and to an output terminal T2 of the timer circuit.

In addition, the other end of the capacitor 24*a* is grounded, and the other end of the resistor 24*b* is connected to the collector of the transistor 24*c*. Then, the base of the transistor 24*c* is connected to the output terminal of the oscillator circuit 22 and its emitter is grounded.

When this timer circuit is used as the timer 715 of FIG. 1, the input terminal T1 is connected to the common connection point P1, and the output terminal T2 is connected to the cathodes of the diodes 717 and 718 of the switch circuit 716.

Next, the operation will be described.

Since the transistor 21 is turned off when the potential of the input terminal T1 of the transistor 21 is at the low level "L," voltage is applied to the capacitor 24*a* from the reference voltage circuit 20 through the diode 23, whereby the capacitor 24*a* in the charge/discharge circuit 24 is charged with current from the reference voltage circuit 20. Accordingly, the potential of the output terminal T2 rises to a predetermined potential as the capacitor 24*a* is charged.

On the other hand, when the potential of the input terminal T1 becomes the high level "H," the transistor 21 is turned on, whereby current flowing from the reference voltage circuit 20 is short-circuited to the transistor 21 to discharge charges charged in the capacitor 24*a* through the resistor 24*b* and the transistor 24*c*. In this case, since the transistor 24*c* is driven by the pulse signal from the oscillator circuit 22, the capacitor 24*a* is intermittently discharged (see FIG. 2F).

Therefore, compared with a conventional charge/discharge circuit consisting of the capacitor 24*a* and the resistor 24*b* that does not use the oscillator circuit 22 and the transistor 24*c* (not shown, while they have different time constants, the circuit configuration of the timer circuits 715 and 710 of FIG. 1 substantially correspond to this configuration), the intermittent-type charge/discharge circuit 24 of FIG. 4 has a longer discharge time because it discharges intermittently, and it can be used as a timer circuit for an extended period of time.

In addition, the discharge time can be further extended by driving the transistor 24*c* with the duty ratio of the pulse signal from the oscillator circuit 22 lowered.

As described, compared with the case where a capacitor is used in a conventional charge/discharge circuit, this embodiment can reduce the capacity of the capacitor used in the timer circuit by making the construction such that the capacitor intermittently discharges, so that the size of the circuit can be reduced.

While the above arrangement is an example where the timer circuit is applied to the timer circuit 715 which prevents continuous power supply in FIG. 1, it can be similarly applied to the timer circuit 710 which prevents accidental activation during the inertial operation of the engine or the starter. In addition, the construction may be such that the capacitor is intermittently charged.

Embodiment 3

The above embodiment may be arranged to provide a CPU (not shown) which checks the operation of the key switch 6, and controls the timers 710 and 715 and the switch circuit 716 in the starter protection device 7A based on a control signal from the CPU.

Figure 5:
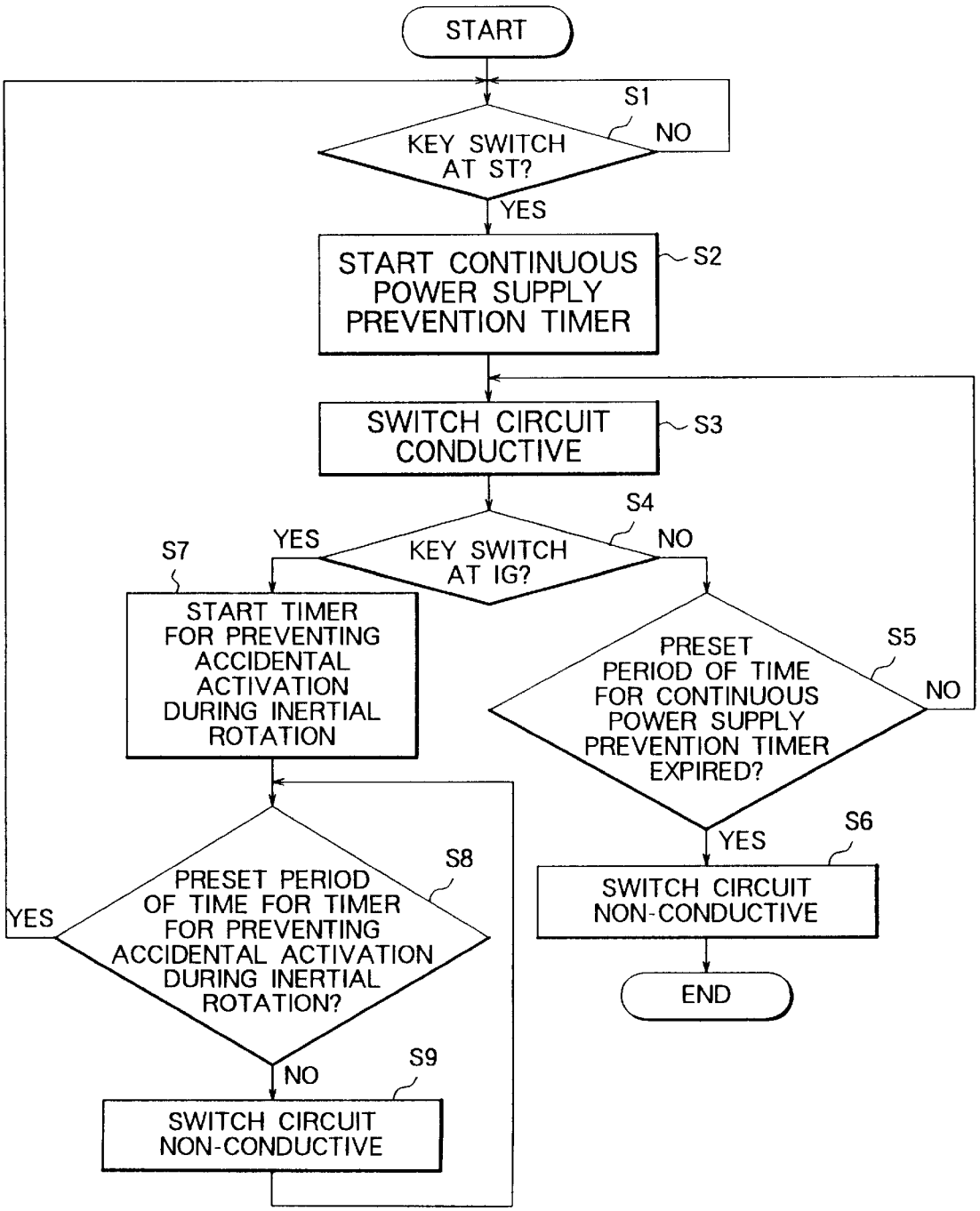
FIG. 5 is a flowchart illustrating embodiment 3 of the present invention.

FIG. 5 shows an example of a flowchart relating to the control operations of the CPU in such an arrangement.

Next, the control operations of the CPU will be described.

First, whether or not the key switch 6 is turned to the ST terminal is determined in step S1. If it is not, the process is on stand-by until it is turned on. If it is, the process proceeds to step S2 where the operation of timer circuit for preventing continuous power supply 715 is started. In step S3, the switch circuit 716 is made conductive to start the starter 2.

Then, whether or not the key switch 6 is released from the ST terminal and returned to the IG terminal is determined in step S4. If it is not, or if the key switch 6 remains turned to the ST terminal, the process proceeds to step S5. In step S5, whether or not the predetermined period of time for the timer circuit 715 has expired is determined. If it has not, the process returns to step S3 and is repeated. If it has expired, the process proceeds to step S6 where the switch circuit 716 is made nonconductive, and the process is completed while the starter 2 is maintained in the nonconductive state which disengages the starter 2 from the engine and prevents continuous power supply.

If, the key switch 6 is released from the ST terminal and returned to the IG terminal in step S4, the process proceeds to step S7 where the timer circuit 710 for preventing accidental activation during the inertial rotation of the engine or the starter starts operating. Then, whether or not the predetermined period of time for the timer circuit 710 has expired is determined in step S8. If it has not, the switch circuit 716 is made nonconductive in step S9 and the process returns to step S8 and is repeated. That is, even if the key switch 6 is turned to the ST terminal the starter 2 cannot be operated during the predetermined period of time the timer circuit 710 operates after stopping power supply to the starter, whereby accidental activation during the inertial rotation of the engine or the motor of the starter 2 can be prevented.

On the other hand, if the predetermined period of time of the timer circuit 710 for preventing accidental activation during the inertial rotation of the starter expires in step S8, the process returns to step S1 and is repeated.

As described, by controlling the timer circuit for preventing continuous power supply, or the timer or switch circuit for preventing accidental activation during inertial rotation with a microcomputer a starter with a higher protection accuracy and a simplified circuit configuration can be attained with the configuration of the present embodiment.

Embodiment 4

While the above embodiments have been described applied to a motor vehicle, they are not limited to such application, but may be applied to any apparatus equipped with an engine started by a starter, such as an emergency generator, with the same advantages.

What is claimed is:

1. A starter protection device for opening a starter auxiliary switch under certain conditions to protect a starter for starting an engine, by making said starter temporarily inoperable, said starter protection device comprising:

switch means closed by turning on a key switch for closing the starter auxiliary switch;

a first timer circuit which starts operating at the same time said key switch is turned on; and a second timer circuit which starts operating at the same time said key switch is released, wherein opening and closing of said switch means is controlled based on outputs of said first and second timer circuits and wherein said starter protection circuit protects the starter without detecting a speed of said engine.

2. The starter protection device as set forth in claim 1, wherein said switch means is opened after expiration of a predetermined period of time in which said first timer circuit operates, and remains open during a predetermined period of time in which said second timer circuit operates.

3. The starter protection device as set forth in claim 1, wherein said starter auxiliary switch is integrated with circuit components other than those of said starter protection device.

4. The starter protection device as set forth in claim 1, further comprising a CPU for checking the operation of the key switch, where said first and second timer circuits and said switch means are controlled on the basis of a control signal from said CPU.

5. A starter protection device for opening a starter auxiliary switch under certain conditions to protect a starter for starting an engine, by making said starter temporarily inoperable, said starter protection device comprising:

switch means closed by turning on a key switch for closing the starter auxiliary switch;

a first timer circuit which starts operating at the same time said key switch is turned on; and a second timer circuit which starts operating at the same time said key switch is released, wherein opening and closing of said switch means is controlled based on outputs of said first and second timer circuits and wherein said switch means comprises a leakage current prevention circuit including a first switch element which becomes conductive as soon as said key switch is turned on, and a switch circuit including a second switch element which becomes conductive as soon as said first switch element becomes conductive and a bridge circuit located between a control electrode of said second switch element and said first and second timer circuits.

6. A starter protection device for opening a starter auxiliary switch under certain conditions to protect a starter for starting an engine, by making said starter temporarily inoperable, said starter protection device comprising:

switch means closed by turning on a key switch for closing the starter auxiliary switch;

a first timer circuit which starts operating at the same time said key switch is turned on;

a second timer circuit which starts operating at the same time said key switch is released; and a power supply circuit connected to said switch means which is operated as soon as said key switch is turned on to supply power to said first and second timer circuits wherein opening and closing of said switch means is controlled based on outputs of said first and second timer circuits.

7. A starter protection device for opening a starter auxiliary switch under certain conditions to protect a starter for starting an engine, by making said starter temporarily inoperable, said starter protection device comprising:

switch means closed by turning on a key switch for closing the starter auxiliary switch;

a first timer circuit which starts operating at the same time said key switch is turned on; and a second timer circuit which starts operating at the same time said key switch is released, wherein opening and closing of said switch means is controlled based on outputs of said first and second timer circuits and wherein at least one of said first and second timer circuits is arranged in an intermittent charge/discharge circuit.

* * * * *